US008156928B1

(12) United States Patent
Blahnik

(10) Patent No.: US 8,156,928 B1
(45) Date of Patent: Apr. 17, 2012

(54) DUAL CAM SYSTEM WITH CROSS-CABLING

(76) Inventor: Roger C. Blahnik, Carney, MI (US)

( * ) Notice: Subject to any disclaimer, the term of this patent is extended or adjusted under 35 U.S.C. 154(b) by 264 days.

(21) Appl. No.: 12/381,695

(22) Filed: Mar. 16, 2009

(51) Int. Cl.
*F41B 5/00* (2006.01)

(52) U.S. Cl. ..... 124/25.6

(58) Field of Classification Search ..... 124/25.6
See application file for complete search history.

(56) References Cited

U.S. PATENT DOCUMENTS 5,975,067 A * 11/1999 Strother ..... 124/25.6
6,082,346 A * 7/2000 Andrews et al. ..... 124/25.6

* cited by examiner

*Primary Examiner* — Gene Kim
*Assistant Examiner* — Amir Klayman
(74) *Attorney, Agent, or Firm* — Richard K Thomson

(57) ABSTRACT

The power cables of a compound bow are cross cabled to ensure the dual cams rotate at the same rate and complete their rotations simultaneously, i.e., are synchronous. Three separate embodiments, each capable of achieving the desired objective, are disclosed.

2 Claims, 3 Drawing Sheets

DUAL CAM SYSTEM WITH CROSS-CABLING

BACKGROUND AND SUMMARY OF THE INVENTION

The present invention is directed to the field of archery. More particularly, the present invention is directed to a cross-cabling method useful with a dual cam system of a compound bow to enhance the bow's performance.

Various dual cam systems are currently available. Most such systems involve cabling which results in a double stop: when the draw cable is pulled to release position, one cam reaches a fully rotated position before the other. This "herky-jerky" movement can be unsettling to the archer and cause errant shots. It is the object of the present invention to provide a cabling technique with a dual cam system that results in the cams reaching full rotation simultaneously every time.

The cable system for a compound bow of the present invention includes a) a first cam means including a first eccentric cam having a first groove extending about a peripheral edge portion for receiving a draw cable and a second eccentric cam affixed to said first eccentric cam for rotation therewith, the second eccentric cam having a second groove extending about a peripheral edge portion for receiving a first power cable; b) a first axle pin upon which the first cam means turns; c) a second cam means including a third eccentric cam having a third groove extending about a peripheral edge portion for receiving the draw cable and a fourth eccentric cam affixed to the third eccentric cam for rotation therewith, the fourth eccentric cam having a fourth groove extending about a peripheral edge portion for receiving a second power cable; d) a second axle pin upon which the second cam means turns; e) a first stake pin affixed to the first eccentric cam securing a first end of the first power cable thereto; f) a second stake pin affixed to the third eccentric cam securing a first end of the second power cable thereto; g) first attachment means securing a second end of the first power cable to the fourth eccentric cam to allow a force line of the power cable to transition from a first side of the second pivot pin to a second side thereof; h) second attachment means securing a second end of the second power cable to the second eccentric cam to allow a force line of the power cable to transition from a first side of the first pivot pin to a second side thereof; whereby the first and second power cables are cross-cabled causing the first and second cam means to pivot in synchronization.

In one embodiment, the first attachment means comprises a first spool mounted for rotation adjacent the first axle pin and a first harness loop forming the second end of the second power cable, the first harness loop extending around at least a portion of said first axle pin and said first spool. Further, a second attachment means comprises a second spool mounted for rotation adjacent the second axle pin and a second harness loop forming the second end of the first power cable, the second harness loop extending around at least a portion of the second axle pin and the second spool.

In a second embodiment, the first attachment means comprises a first hook linkage mounted for rotation about an axis adjacent the first axle pin and the second end of the second power cable secured to a distal end of the first hook linkage. Further, the second attachment means comprises a second hook linkage mounted for rotation about an axis adjacent the second axle pin and the second end of the first power cable secured to a distal end of the second hook linkage.

In a third embodiment, the first attachment means comprises a first cam lobe secured to the first and second eccentric cams for rotation therewith about the first axle pin, a first idler spool floating between the first and second cam means, a first harness loop extending around the first cam lobe and the first idler spool, the second end of the second power cable being secured to the first idler spool. Further, the second attachment means comprises a second cam lobe secured to the third and fourth eccentric cams for rotation therewith about the second axle pin, a second idler spool floating between the first and second cam means, a second harness loop extending around the second cam lobe and the second idler spool, the second end of the first power cable being secured to the second idler spool.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1B:
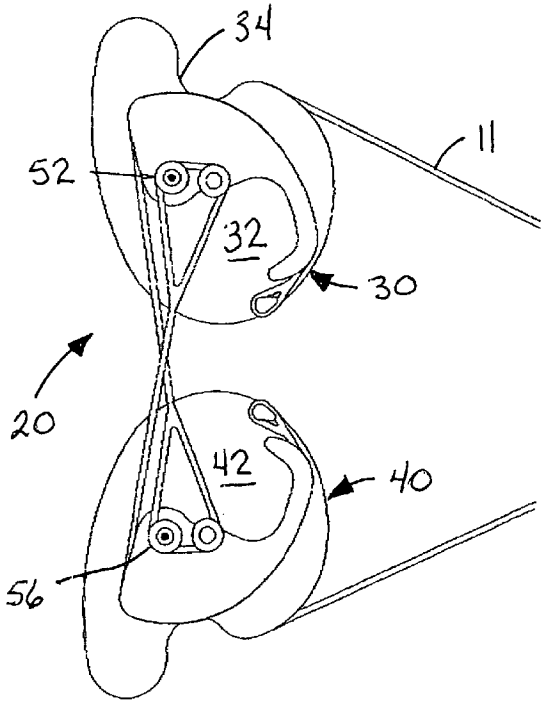
FIG. 1B is a schematic front view of the first embodiment at full draw.
Figure 1A:
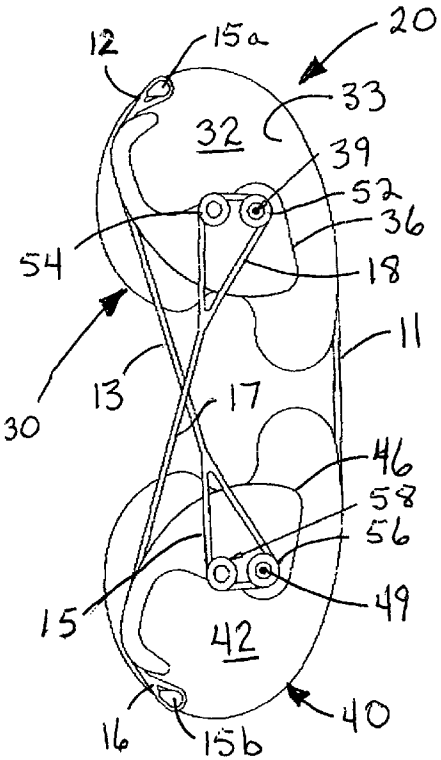
FIG. 1A is a schematic front view of a first embodiment of the dual cam system of the present invention in an at rest position.

A first embodiment of the dual cam system with cross cabling is shown in FIGS. 1A and 1B generally at 20. First cam means 30 is comprised of first eccentric cam 32 with an outer peripheral groove (not shown) which receives draw cable 11. Draw cable is wrapped around the periphery of eccentric cam 32 and the end thereof is attached thereto in any of a number of conventional ways, i.e., staked to the groove in the lobe recess 34 or wrapped about a pin on the back side of the cam 32. Second eccentric cam 36 is attached to first eccentric cam 32 for rotation therewith and has a peripheral groove (not shown) which receives first power cable 13. A first end 12 of power cable 13 is secured to pin 15*a* on the face 33 of eccentric cam 32. Cam means 30 rotates about axle pin 39.

Second cam means 40 is comprised of a third eccentric cam 42 (preferably identical to first eccentric cam 30) and a fourth eccentric cam 46 (preferably identical to second eccentric cam 36) attached thereto for rotation therewith about axle pin 49. The opposite end of draw cable 11 is attached to third eccentric cam 42 in the same manner as used to attach the first end to cam 32. A first end 16 of second power cable 17 is secured to pin 15*b*.

A first spool 52 is mounted for rotation on the first axle pin 39 and a second spool 54 is mounted on the second eccentric cam 46 for rotation adjacent the first spool 52. First harness loop 18 is formed on second end of second power cable 17 and extends at least partially around first spool 52 and second spool 54. A third spool 56 is mounted for rotation on the second axle pin 49 and a fourth spool 58 is mounted on the fourth eccentric cam 46 for rotation adjacent the third spool 56. Second harness loop 15 is formed on second end of first power cable 13 and extends at least partially around third spool 56 and fourth spool 58.

As draw cable 11 is retracted to full draw, cam means 30 and 40 will rotate about axle pins 39 and 49 respectively. First spool 52 and second spool 54, which form a first spool pair, will rotate within first harness loop 18 and first end 16 of second power cable 17 will more fully engage (wrap around) fourth eccentric cam 36 (FIG. 1B). Similarly, third spool 56 and fourth spool 58 (second spool pair) will rotate within second harness loop 15 as first end 12 of power cable 13 wraps around second eccentric cam 36. As can be seen by comparing FIG. 1A to FIG. 1B, this has the effect of enabling the force line of power cable 17 (i.e., an extension of the linear cable 17) to transition from one side of axle pin 39 to the other, in a manner similar to Applicant's earlier U.S. Pat. No. 7,059,315 which is hereby incorporated by reference. Similarly, the force line of power cable 13 transitions from one side of axle pin 49 to the other. Synchronization of rotation of first cam means 30 with second cam means 40 is ensured and a smoother draw is the result.

Figure 2B:
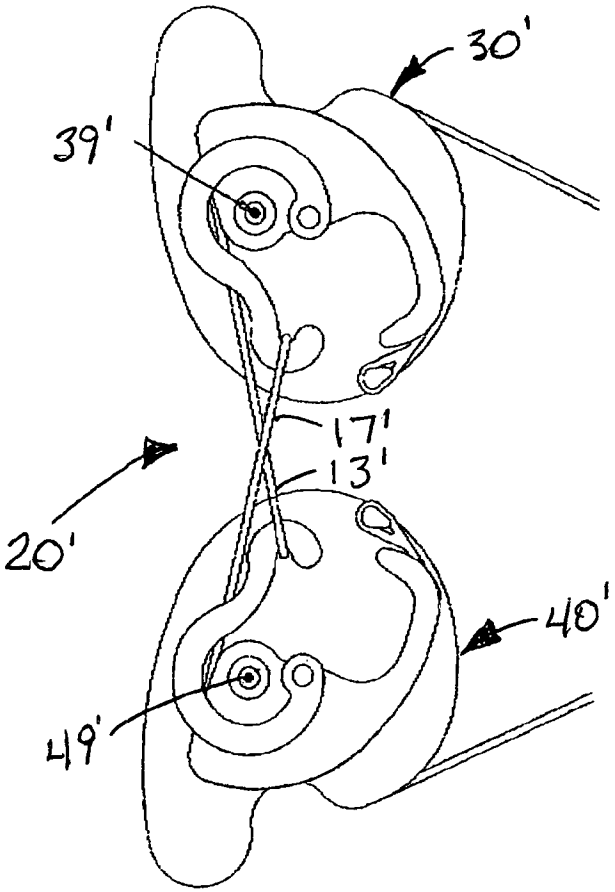
FIG. 2B is a schematic front view of a second embodiment at full draw.
Figure 2A:
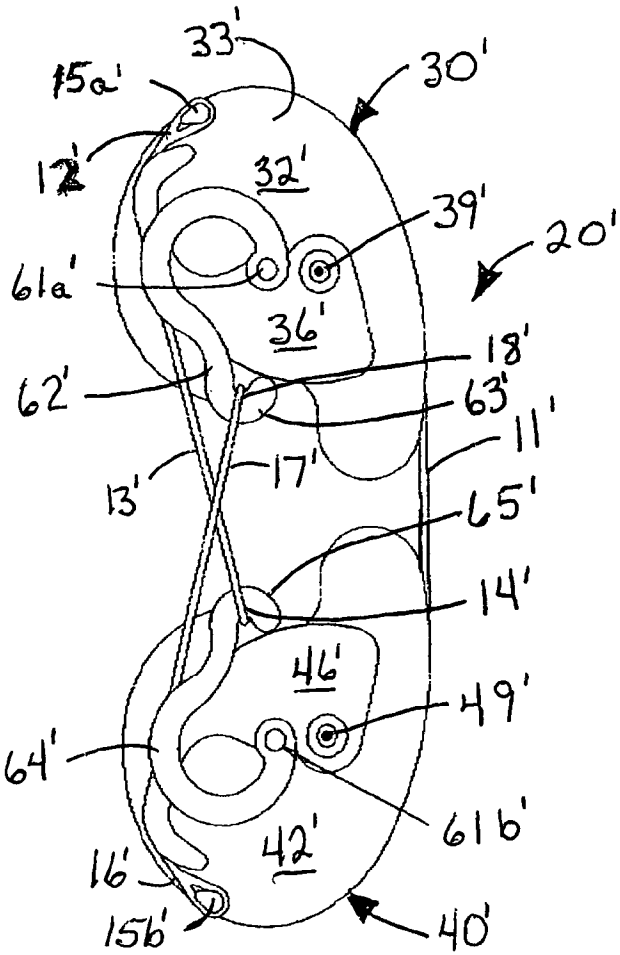
FIG. 2A is a schematic front view of a second embodiment of the present invention at rest.

A second embodiment of the dual cam system with cross cabling is shown in FIGS. 2A and 2B generally at 20'. First cam means 30' is comprised of first eccentric cam 32' with an outer peripheral groove (not shown) which receives draw cable 11'. Second eccentric cam 36' is attached to first eccentric cam 32' as in the previous embodiment. First end 12' of power cable 13' is secured to pin 15*a'* on the face 33' of eccentric cam 32'. Cam means 30' rotates about axle pin 39'. Second cam means 40' is comprised of a third eccentric cam 42' and a fourth eccentric cam 46' attached thereto for rotation therewith about axle pin 49'. A first end 16' of second power cable 17' is secured to pin 15*b'*.

In this embodiment, a first hook linkage 62' is mounted for rotation about an axle 61*a'* adjacent first axle pin 39' and second end 18' of second power cable 17' is connected to the end 63' of hook linkage 62'. A second hook linkage 64' is mounted for rotation about an axle 61*b'* adjacent second axle pin 49' and second end 14' of first power cable 13' is connected to the end 65' of hook linkage 64'. Axles 61*a'* and 61*b'* are rotatably secured to eccentric cams 36' and 46', respectively. As with the first embodiment, when draw cable 11' is retracted to full draw, cam means 30' and 40' will rotate about axle pins 39' and 49', respectively. As seen by comparing FIGS. 2A and 2B, the force line of power cables 13' and 17' effectively act through axle pins 49' and 39', respectively (moving from a first side to a second side thereof). Once again, synchronization of rotation of first cam means 30' with second cam means 40' is ensured.

Figure 3B:
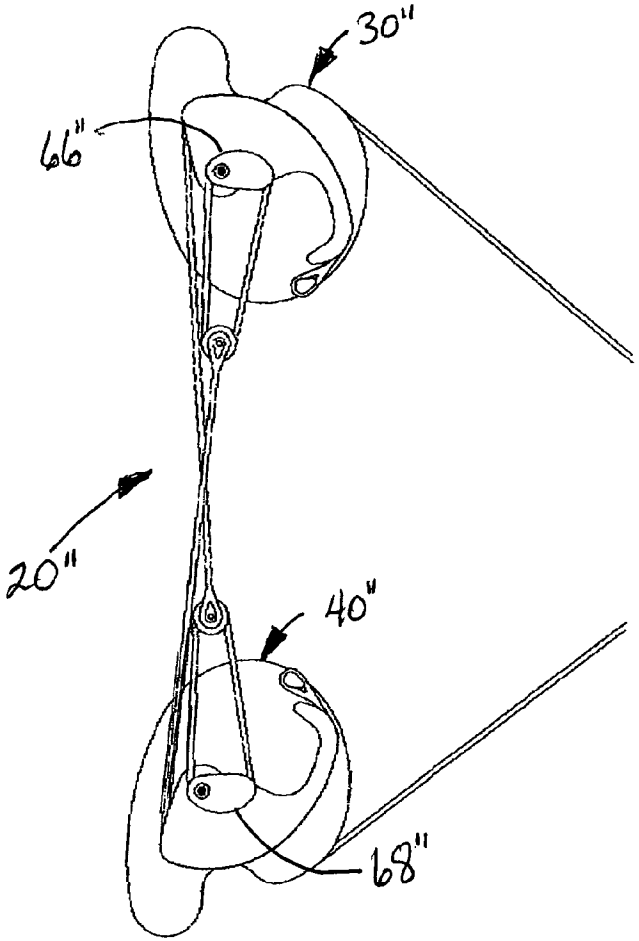
FIG. 3A is a schematic front view of a third embodiment of the present invention; and, FIG. 3B is a schematic front view of the third embodiment at full draw.
Figure 3A:
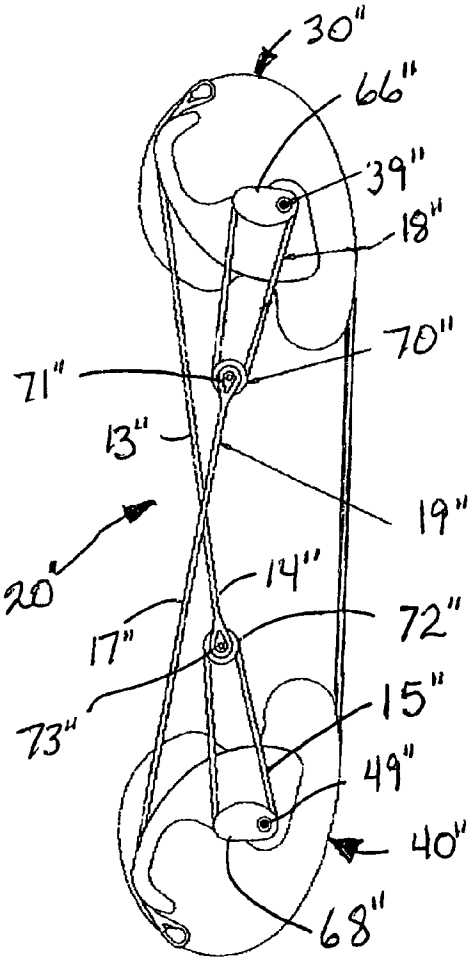

A third embodiment of the dual cam system with cross cabling is depicted in FIGS. 3A and 3B generally at 20". In this embodiment, the first and second spools 52, 54 of the first embodiment are replaced by a first cam lobe 66" and third and fourth spools 56, 58 by a second cam lobe 68". Cam lobes 66" and 68" are attached for rotation with cam means 30" and 40", respectively. A first harness loop 18" encircles first cam lobe 66" and a first floating idler spool 70". Second end 19" of second power cable 17" is secured to a pin 71" extending from first idler spool 70". Similarly, a second harness loop 15" encircles second cam lobe 68" and a second floating idler spool 72". Second end 14" of first power cable 13" is secured to a pin 73" extending from second idler spool 72". As with the previous two embodiments, this third cross cabling arrangement ensures the synchronization of the cam means 30" and 40" and, once again, the configuration allows the force lines for power cables 17" and 13" to transition from one side of axle pins 39" and 49" to the other.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A cable system for a compound bow, said cable system comprising a) a first cam means including a first eccentric cam having a first groove extending about a peripheral edge portion for receiving a draw cable and a second eccentric cam affixed to said first eccentric cam for rotation therewith, said second eccentric cam having a second groove extending about a peripheral edge portion for receiving a first power cable;

b) a first axle pin upon which said first cam means turns;

c) a second cam means including a third eccentric cam having a third groove extending about a peripheral edge portion for receiving the draw cable and a fourth eccentric cam affixed to said third eccentric cam for rotation therewith, said fourth eccentric cam having a fourth groove extending about a peripheral edge portion for receiving a second power cable;

d) a second axle pin upon which said second cam means turns;

e) a first stake pin affixed to said first eccentric cam securing a first end of said first power cable thereto;

f) a second stake pin affixed to said third eccentric cam securing a first end of said second power cable thereto;

g) first attachment means securing a second end of said first power cable to said fourth eccentric cam to allow a force line of said power cable to transition from a first side of said second pivot pin to a second side thereof said first attachment means including a first spool mounted for rotation on said first axle pin and a second spool mounted for rotation adjacent said first spool, a first harness loop forming said second end of said second power cable, said first harness loop extending around the entire outer periphery of both said first spool and said second spool;

h) second attachment means securing a second end of said second power cable to said second eccentric cam to allow a force line of said power cable to transition from a first side of said first pivot pin to a second side thereof;

whereby said first and second power cables are cross-cabled causing said first and second cam means to rotate in synchronization.

2. The cable system of claim 1 wherein said second attachment means comprises a third spool mounted for rotation with said second axle pin and a fourth spool mounted for rotation adjacent said third spool, a second harness loop forming said second end of said first power cable, said second harness loop extending around the entire outer periphery of both said third spool and said fourth spool.

* * * * *